US006053121A

United States Patent [19]

Tamashima et al.

[11] Patent Number: 6,053,121

[45] Date of Patent: Apr. 25, 2000

[54] METHOD AND APPARATUS FOR EXCHANGING BALLAST WATER IN A SHIP

[75] Inventors: Masahiro Tamashima, Nagasaki Pref.; Hisashi Numata, Hiroshima Pref., both of Japan

[73] Assignee: Teekay Shipping Corporation, Nassau, Bahamas

[21] Appl. No.: 09/220,383

[22] Filed: Dec. 28, 1998

[51] Int. Cl.[7] ..... B63B 39/03

[52] U.S. Cl. ..... 114/125; 114/74 R

[58] Field of Search ..... 114/317, 333, 114/74 R, 74 T, 74 A, 75, 125, 183 R, 185

[56] References Cited

U.S. PATENT DOCUMENTS 322,374 7/1885 Haydn ..... 114/185

4,759,307 7/1988 Scott ..... 114/125

*Primary Examiner*—Jesus D. Sotelo

*Attorney, Agent, or Firm*—Elbie R. de Kock

[57] ABSTRACT

A system for automatically replacing ballast water in a ballast tank of a ship comprises a water inlet port on a part of the ship where the water pressure acting on the ship when in forward motion in the water is higher than the pressure of the ballast water being replaced, a water discharge outlet in the ballast tank and a water inlet passage extending between the water inlet port and the ballast tank for introducing water into the ballast tank at a higher pressure than the ballast water in the tank. In this way the ballast water is forced from the ballast tank through the discharge outlet to be replaced by water introduced through the inlet port. A method for replacing ballast water in the ballast tank of a ship is also provided.

6 Claims, 5 Drawing Sheets

METHOD AND APPARATUS FOR EXCHANGING BALLAST WATER IN A SHIP

FIELD OF THE INVENTION

This invention relates to a method and apparatus for exchanging ballast water in a ballast tank of a ship as well as a ship provided with a system for exchanging ballast water.

BACKGROUND OF THE INVENTION

A ballast tank is provided on a ship in order to stabilize the vessel. In order to perform this function, the ballast tank is charged with ballast water. Since there is a possibility of soiled or dirty water being introduced into the ballast tank, it is necessary or desirable to exchange such dirty ballast water with clean water.

Conventionally, the ballast water is exchanged by using a pump. This requires power as well as an operator to control the operation.

It is an object of the present invention to facilitate the exchange of ballast water.

SUMMARY OF THE INVENTION

According to the invention, there is provided a method of replacing ballast water in a ballast tank of a ship, comprising the steps of providing a water inlet port on a part of the ship where the water pressure acting on the ship when in forward motion in the water is higher than the pressure of the ballast water to be replaced; connecting said water inlet to a ballast tank containing the ballast water to be replaced in order to introduce said higher pressure water from the inlet port into the ballast tank; and using the pressure difference between the higher pressure water from said inlet port and the ballast water to force the ballast water from the ballast tank, thereby to replace the ballast water with the water from the inlet port.

Also according to the invention, there is provided a system for automatically replacing ballast water in a ballast tank of a ship, comprising a water inlet port on a part of the ship where the water pressure acting on the ship when in forward motion in the water is higher than the pressure of the ballast water to be replaced; a water discharge outlet in the ballast tank; and a water inlet passage extending between said water inlet port and said ballast tank for introducing water into the ballast tank at a higher pressure than the ballast water in the tank, thereby to force the ballast water from the ballast tank through said discharge outlet.

Preferably, the water inlet port is located at a front portion of the bow of the ship which is normally under water during forward motion of the ship.

The invention also extends to a ship provided with a ballast water replacement system as described above.

Further objects and advantages of the invention will become apparent from the description of preferred embodiments of the invention below.

BRIEF DESCRIPTION OF THE DRAWINGS

The invention will now be described, by way of examples, with reference to the accompanying drawings, in which.

DETAILED DESCRIPTION OF PREFERRED EMBODIMENTS

Figure 1:
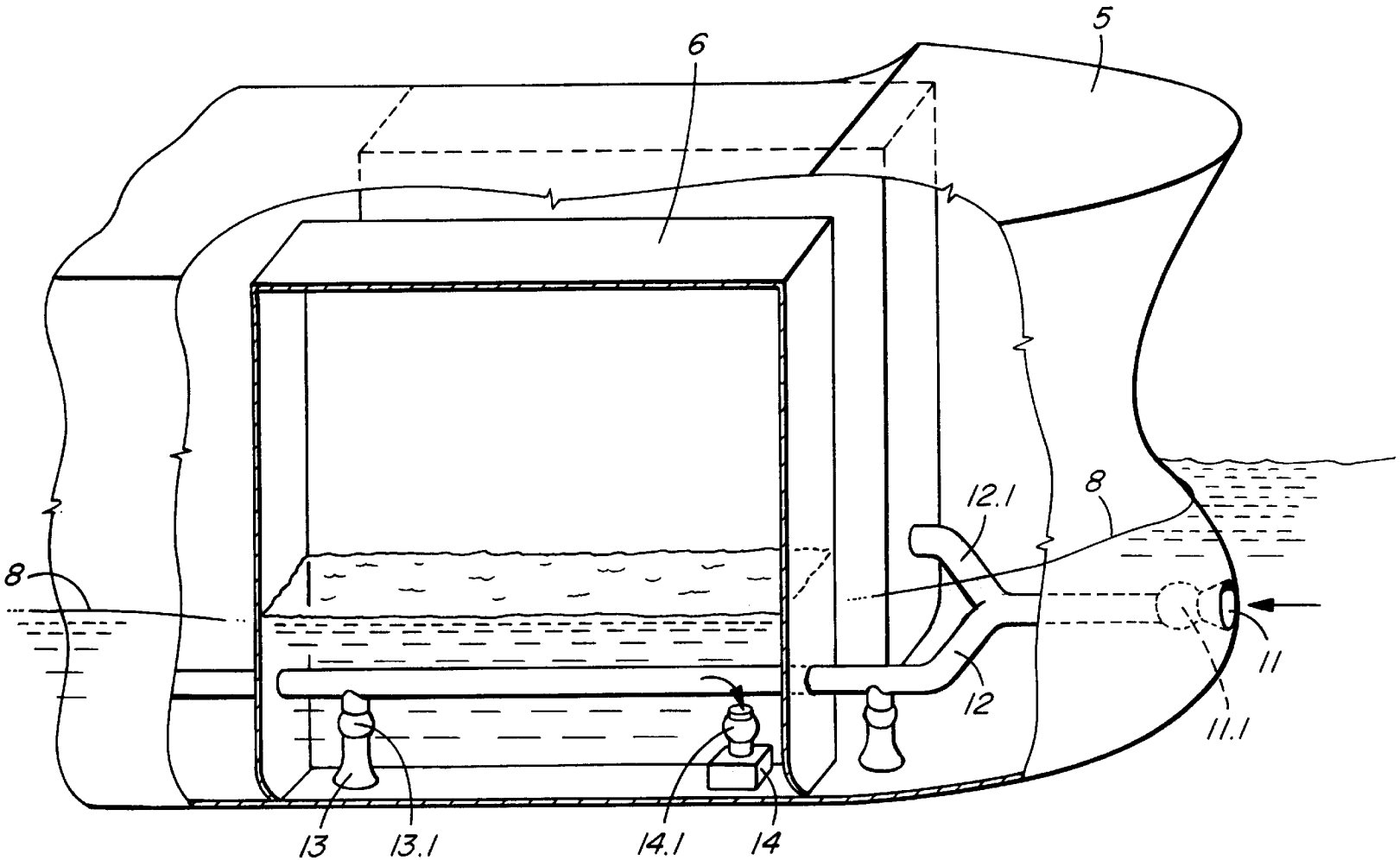
FIG. 1 is a schematic perspective view of the bow side of a ship, showing an embodiment of the invention.
Figure 2A:
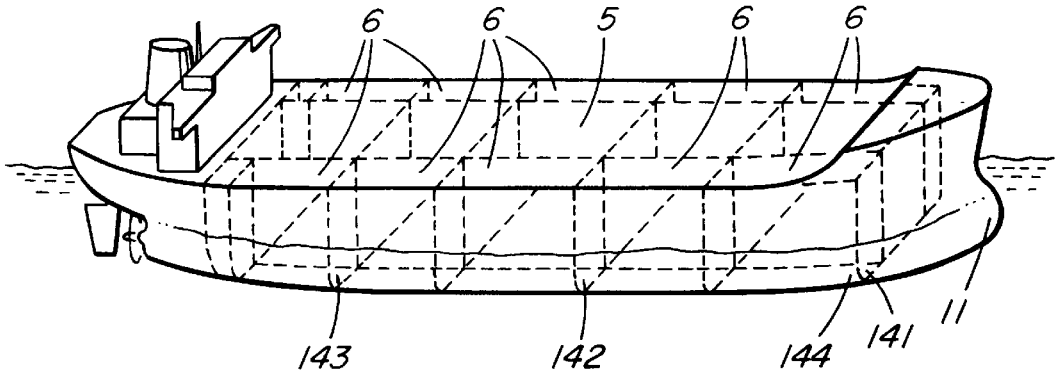
FIG. 2A is a perspective view of a ship showing the position of an inlet port and a number of discharge outlets in accordance with an embodiment of the invention.

In FIGS. 1 and 2, a ship 5 is shown having a series of ballast tanks 6 extending along both sides thereof. A water inlet port 11 is provided in the bow of the ship 5 at a location which is normally below the water level 8 when the ship 5 is moving forward in the water, as shown in FIG. 1. The port 11 is tapered outwardly to facilitate a natural inflow of seawater into the port 11 during forward motion of the ship 5.

A water inlet passage, such as a steel pipe 12, extends from the inlet 11 through the ballast tanks 6, as shown in FIG. 1. It is branched, as shown at 12.1 so as to extend through the ballast tanks 6 on both sides of the ship 5.

Each ballast tank 6 is provided with a water inlet 13 on the pipe 12 for introducing water into the tank 6. As shown, the inlet 13 is located on one side of the tank 6. Each inlet 13 is provided with a valve 13.1 for opening and closing the inlet 13.

Each ballast tank 6 is further provided with a water discharge outlet 14 and a valve 14.1 for opening and closing the outlet 14. As shown, the outlet 14 is located forwardly of the inlet 13 in the direction of movement of the ship and at the bottom of the ballast tank 6 at an opposite end of the tank 6 so that it is at a position furthest away from the water inlet 13.

A valve 11.1 is provided in the port 11 for opening and closing the port 11, as required.

Since the inlet port 11 is located in a position in which the water pressure acting on a moving ship is high, e.g. at a location below the water level 8 at a front part of the bow of the ship 5, a pressure difference, or difference in water head, is created between the inlet port 11 and the discharge outlet 14. This enables water to be supplied to the ballast tank 6 without requiring additional power to pump water from the inlet port 11 to the tank 6.

Due to the head difference, water from the inlet port 11 flows through the inlet 13 at one side of the ballast tank 6 to urge any dirty ballast water present in the tank 6 and requiring replacement, to the other side of the tank 6 and to discharge the water through the outlet 14. In this way, dirty ballast water is automatically replaced with fresh water during a sea voyage.

Figure 3A:
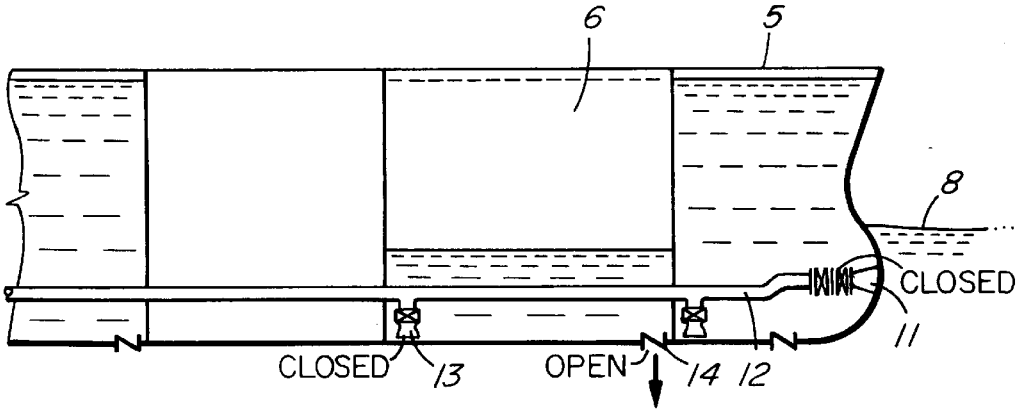
FIGS. 3A and 3B are sectional side views, illustrating a ballast water exchange operation in accordance with an embodiment of the invention.

Normally the valve 11.1 will be closed, preventing the inflow of water into the inlet port 11. Prior to initiating a water replacement operation, the valve 14.1 is opened. This results in the water in the tank 6 automatically being drained under the force of gravity to a reduced height corresponding with the ship's draft level, as shown in FIG. 3A.

Next, the valves 11.1 and 13.1 are opened. Water then flows under pressure through the pipe 12 from the inlet port 11 into the ballast tank 6.

Figure 3B:
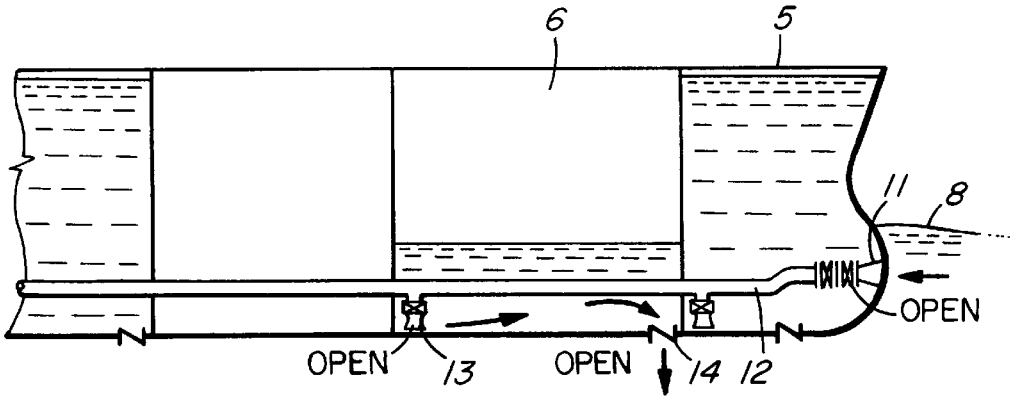

Since the water pressure in the pipe 12 at the inlet 13 is substantially the same as at the inlet port 11 and higher than the pressure of the ballast water in the tank 6, the water in the tank 6 is forced to the opposite side of the tank 6 and discharged through the outlet 14, as shown in FIG. 3B.

After the dirty ballast water has been replaced with fresh seawater, the valves 11.1, 13.1 and 14.1 are closed and the water exchange operation is completed. If necessary, or desired the water in the tank 6 may be topped up to a desired level using a pump.

Figure 2B:
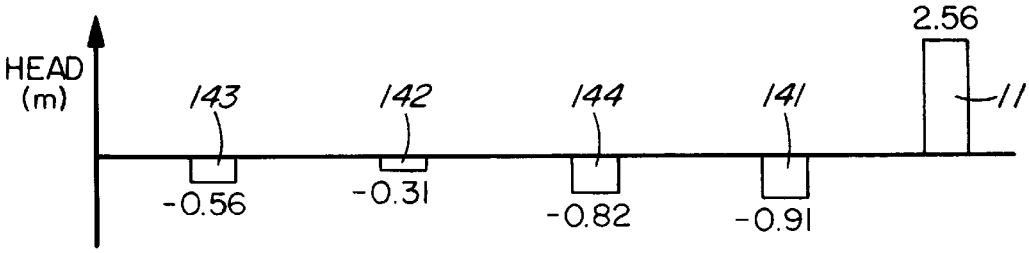
FIG. 2B is a relational view showing the difference between the water head at the inlet port and each of the discharge outlets of FIG. 2A.

The above description has been in respect of a single ballast tank 6. However, the same operation can be applied to any of the other ballast tanks 6 requiring the replacement of dirty ballast water. For this purpose, water discharge outlets can be provided at different locations in the ship 5, as, for example, indicated by reference numerals 141, 142, 143 and 144 in FIG. 2A. Examples of the differences in water head between the inlet port 11 and the discharge ports 141 to 144 are shown in FIG. 2B.

TEST EXAMPLE

The following test was carried out to demonstrate the replacement of ballast water in a ballast tank by the difference in water pressure, without requiring the application of additional power.

Figure 4:
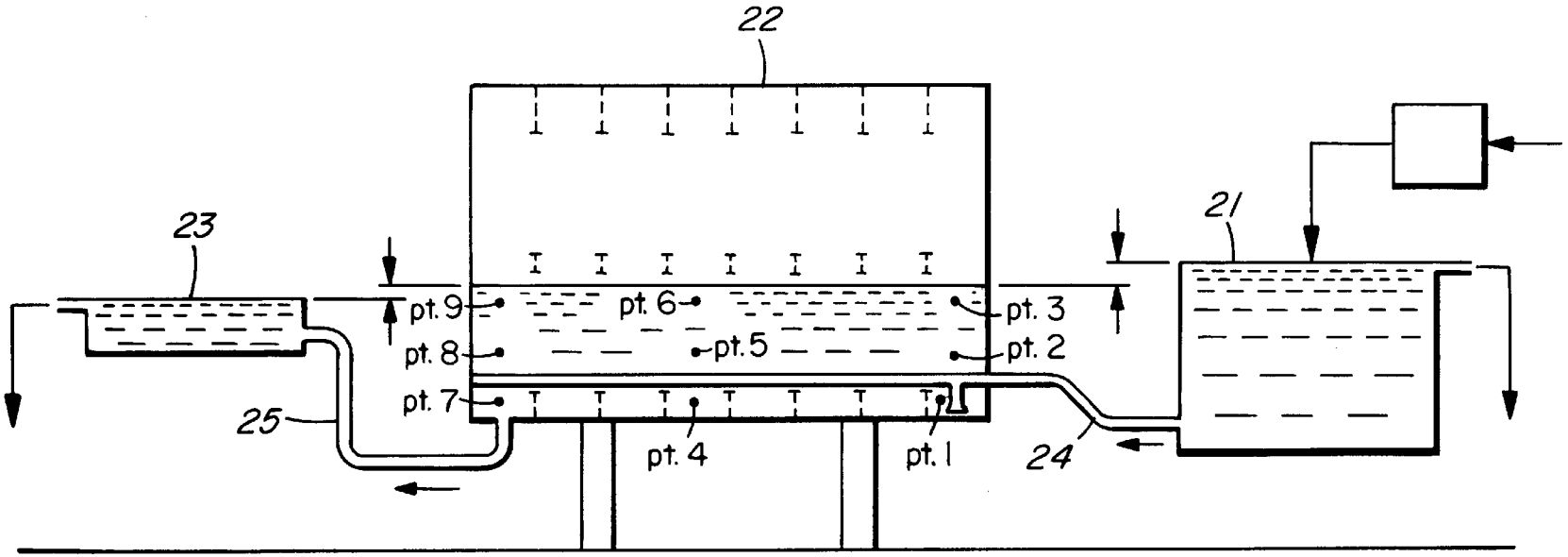
FIG. 4 is a schematical side view of test apparatus for observing the exchange of water in a ballast tank.

The test apparatus is shown in FIG. 4. A tank 21 for generating water pressure corresponding to the inlet port 11 is provided. Fresh water is introduced into the tank 21. An overflow is provided for the tank 21, as shown. A sealed tank 22, which corresponds with the ballast tank 6, is also provided. The tank 22 is charged with salt water and a plurality of salt concentration detection points 1 to 9 are provided inside the tank 22. A tank 23 for generating water pressure to simulate the discharge outlet 14 is further provided. An overflow is provided for the tank 23. The tanks 21 and 22 are then connected by means of a water passage 24. In addition, the tanks 22 and 23 are connected by a water passage 25.

Water-exchange is tested by arranging the water level in the tank 21 to be higher than the water level in the tank 22 and arranging the water level in the tank 23 to be lower than the water level in the tank 22. Fresh water is supplied to the tank 22 from the tank 21 by using the difference in water level. The change in the salt concentration at the different salt concentration detection points 1 to 9 in the tank 22 is measured.

Figure 5:
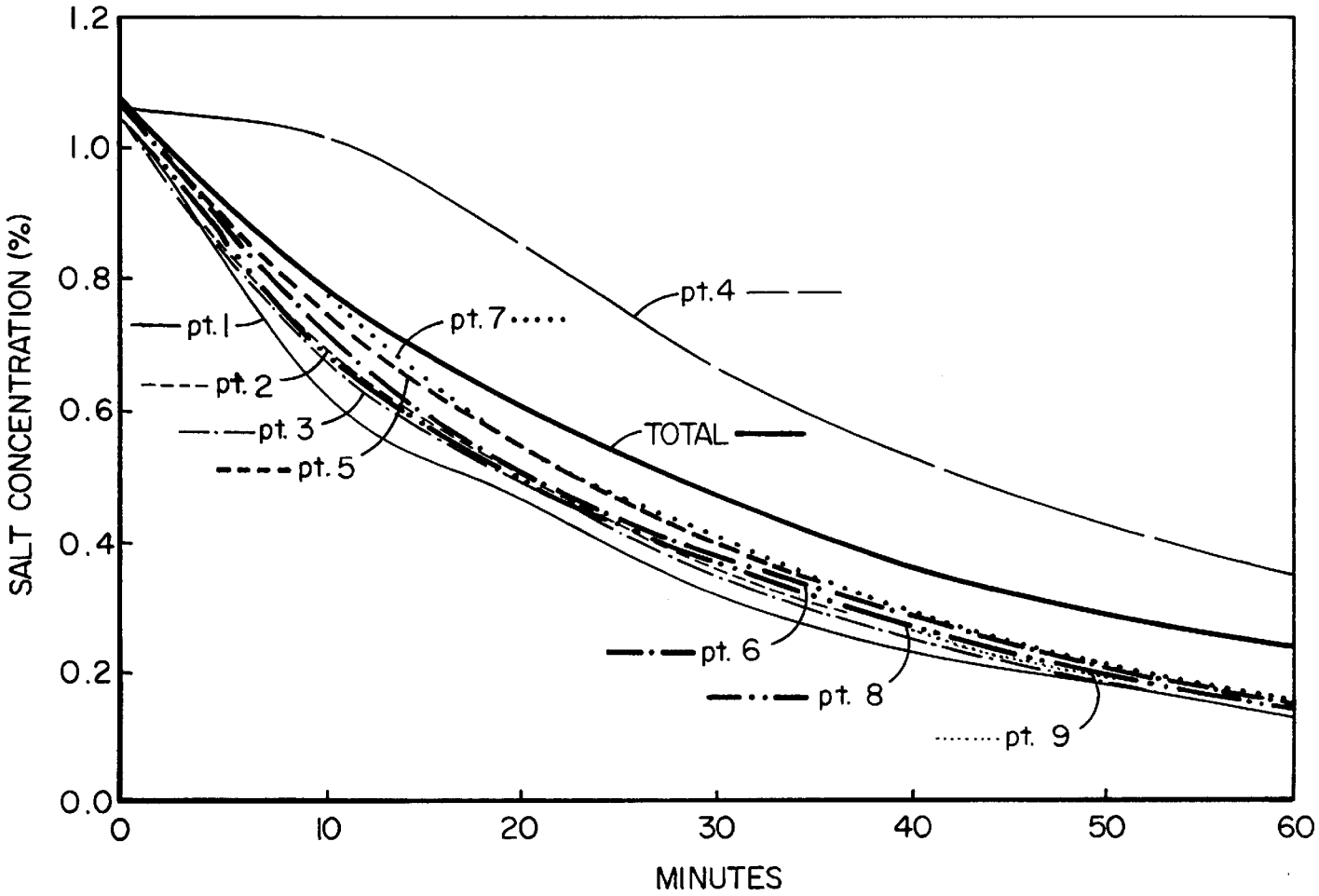
FIG. 5 is a graph illustrating the results of a test measuring the change of salt concentration in a tank using the apparatus of FIG. 4.

The change in the salt concentration with time at each of the salt concentration detection points 1 to 9 due to a water pressure difference corresponding with that of a ship moving at a speed of 15 knots, is shown in FIG. 5. The salt concentration is reduced to about a quarter of the original value after sixty minutes has passed, indicating that about three quarters of the salt water in the tank 22 has been exchanged.

The invention is not limited to the embodiments described above, and various modifications are, of course, possible within the scope of the invention. For example, in the embodiment described above, the inlet port 11 is provided at a position below the water level at the front part of the bow at which the water pressure acting on a ship in motion is highest. However, the invention is not limited to this, and the inlet port may be provided at other locations as long as the water pressure is higher than the water pressure in the ballast tank 6.

Further, in the embodiment described above, the water passage 12 is branched and connected to each of the ballast tanks 6 on both sides of the ship. However, the invention is not limited to this, and the arrangement may be such that a plurality of inlet passages 12 corresponding to the number of ballast tanks 6 are provided, an end of each of the plurality of inlet passages 12 being connected to each of the ballast tanks 6. Therefore, in contrast with the branching of the inlet passage 12, the exchange water can be supplied to each of the ballast tanks 6 at the same pressure.

It is an advantage of the invention that the ballast water in a ballast tank can be exchanged without the application of power other than the power generated by the moving ship, thereby involving no energy cost for the exchange of ballast water. Further, an operator for controlling the application of power is not required, further reducing the cost.

While only preferred embodiments of the invention have been described herein in detail, the invention is not limited thereby and modifications can be made within the scope of the attached claims.

What is claimed is:

1. A method of replacing ballast water in a ballast tank of a ship, comprising the steps of:

providing a water inlet port on a part of the ship where the water pressure acting on the ship when in forward motion in the water is higher than the pressure of the ballast water to be replaced;

connecting said water inlet to a ballast tank containing the ballast water to be replaced in order to introduce said higher pressure water from the inlet port into the ballast tank; and using the pressure difference between the higher pressure water from said inlet port and the ballast water to force the ballast water from the ballast tank, thereby to replace the ballast water with the water from the inlet port.

2. The method according to claim 1 wherein said inlet port is located at a front portion of the bow of the ship.

3. A system for automatically replacing ballast water in a ballast tank of a ship, comprising:

a water inlet port on a part of the ship where the water pressure acting on the ship when in forward motion in the water is higher than the pressure of the ballast water to be replaced;

a water discharge outlet in the ballast tank; and a water inlet passage extending between said water inlet port and said ballast tank for introducing water into the ballast tank at a higher pressure than the ballast water in the tank, thereby to force the ballast water from the ballast tank through said discharge outlet.

4. The system according to claim 3, wherein said water inlet port is located at a front portion of the bow of the ship.

5. The system according to claim 3, wherein the ship is provided with a plurality of ballast tanks which are connected to said water inlet port through said water inlet passage.

6. A ship provided with a system for replacing ballast water according to claim 3.

* * * * *